United States Patent [19]

Davis

[11] 4,313,153

[45] Jan. 26, 1982

[54] PAN-TYPE LIGHTING FIXTURE

[75] Inventor: George O. Davis, Brea, Calif.

[73] Assignee: Scott Paper Company, Philadelphia, Pa.

[21] Appl. No.: 182,681

[22] Filed: Aug. 29, 1980

[51] Int. Cl.[3] ..... F21V 29/00

[52] U.S. Cl. ..... 362/184; 362/147

[58] Field of Search ..... 362/294, 147

[56] References Cited

U.S. PATENT DOCUMENTS 4,104,713 8/1978 Chan et al. ..... 362/294

*Primary Examiner*—Stephen J. Lechert, Jr.

*Attorney, Agent, or Firm*—Martin L. Faigus; John W. Kane, Jr.

[57] ABSTRACT

A pan-type lighting fixture for mounting in association with an outlet box (3) in a ceiling is characterized by a heat-dissipating base (12) having a generally vertical sidewall section (18) and a generally horizontal planar wall (24) intermediate opposed ends (20 & 22) of the sidewall section. The horizontal wall divides the base into upper and lower compartments (26 & 28) and sockets (31) for receiving incandescent lamps are secured through mounting means (30) to the lower surface of the intermediate wall (24). A layer of insulating material (14) is disposed in the lower compartment of the base, and a layer of insulating material (15) is disposed in the upper compartment of the base. A mounting stud (13) includes a heat-insulating threaded plastic stem (38) passing through a central opening (39) in the horizontal wall of the base for connection with a threaded opening (40) associated with the outlet box. The lighting fixture complies with the UL temperature limit of 60° C.

8 Claims, 1 Drawing Figure

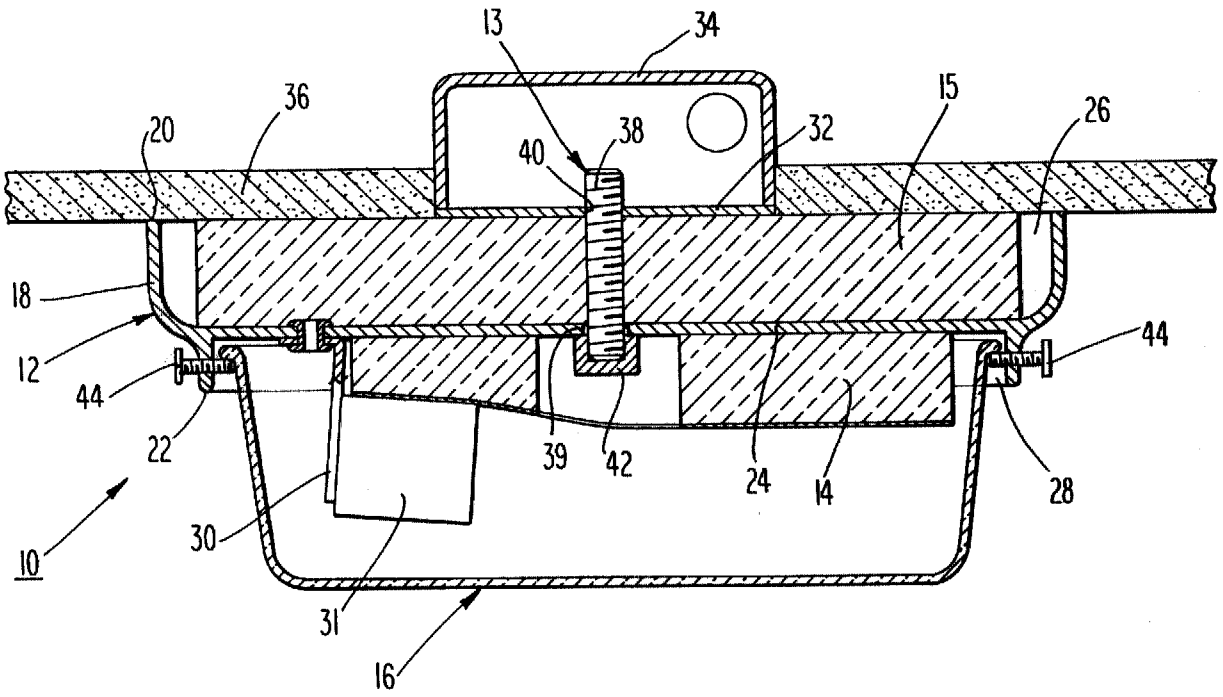
26
15
32
34
38
13
40
36
20
18
12
44
10
22
30
31
16
39
42
24
14
28
44

PAN-TYPE LIGHTING FIXTURE

TECHNICAL FIELD

This invention relates generally to the field of lighting fixtures, and more particularly to a pan-type lighting fixture employing incandescent bulbs and having improved thermal insulation properties.

As referred to throughout this application, a "pan-type fixture" or "pan-type lighting fixture" is one having a base that is no more than four inches high and that is mounted substantially flush with the ceiling. In addition, one or more sockets for receiving incandescent light bulbs are connected to the base, and each socket has a central axis disposed generally horizontally (i.e., the axis does not deviate from the horizontal by more than 45°).

BACKGROUND ART

Over the past decade there has been a significant increase in the concern for fire safety in the home. This is particularly evidenced by an increased awareness and interest in fire safety devices for use in the home; such as fire ladders, fire extinguishers and smoke alarms.

Consistent with the increased concern for fire safety is the imposition by Underwriters Laboratories, Inc. of more stringent thermal requirements for pan-type lighting fixtures. In particular, U/L 57Standard for Electric Lighting Fixtures dated Jan. 13, 1978, sets forth stringent temperature limits which cannot be exceeded if U/L approval is to be obtained.

Section 27.3 of U/L 57 states:

> TEMPERATURE LIMITS—A fixture subjected to a temperature test shall not cause temperatures to exceed values specified in paragraph 27.4.

The instant invention primarily is concerned with the requirements set forth in the first sentence of 27.4B, which provides as follows:

> 60° (140° F.) at any point within a fixture wiring box or compartment, or if the fixture is to be mounted to an outlet box, at any point the supply wire could normally contact (the supply wire inside the outlet box is 6" in length).

Pan-type fixtures must meet the above temperature requirements in order to receive U/L approval for use in houses wherein the wiring does not justify a higher temperature rating; which is commonly the case in older homes.

It is known in the prior art to employ a heat dissipating material such as aluminum in lighting fixtures and appliances. This is evidenced by U.S. Pat. No. 4,107,768, issued to Lemkin (note the aluminum ring D of light bulb globe A); U.S. Pat. No. 3,461,283, issued to Hahn (note the cast aluminum housing 10 of the vandal-proof luminary); U.S. Pat. No. 3,869,606, issued to Fordsmand (note housing 10 of the fluorsecent unit); U.S. Pat. No. 3,348,036, issued to both Bodian et. al, (note metal frame 41 of the examination light) and U.S. Pat. No. 3,560,728, issued to Atkin (note hollow conical housing 11 of the floodlight).

Although all of the above patents disclose the use of aluminum as a heat dissipating material in lighting devices, the use of such a material by itself in forming the base of a pan-type fixture will not provide the necessary heat insulating characteristics to meet the above-discussed U/L requirements.

It is generally desirable to employ a central, threaded mounting stud to mount a pan-type fixture on the ceiling in association with an outlet box. This is evidenced by U.S. Pat. Nos. 1,825,920, issued to Popp; 1,600,639, issued to Williamson; 1,906,197, issued to Mangin; 1,155,350, issued to Gilson et. al. and 4,044,246, issued to Docimo et al. Prior to this invention all of the studs employed to mount pan-type fixtures, to the best of applicant's knowledge, have been of a metal, heat conductive material. None of the above petents suggest the use of any other type of material for such a stud, and a pan-type fixture employing a metal mounting stud will not meet the U/L requirements set forth in Section 27.4B, 1st sentence.

DISCLOSURE OF INVENTION

The present invention relates to a pan-type fixture having an extremely low profile, and yet meeting the stringent temperature requirements of U/L 57-Section 27.4B, 1st sentence. This is achieved by a unique combination of heat insulating and heat conducting elements associated with the fixture.

The pan-type lighting fixture of this invention is characterized by a heat-dissipating base having a thermal conductivity in excess of 0.4 calories per cm. per sec. per °C. (e.g., aluminum), said base having a generally vertical sidewall section and a generally horizontal, planar dividing wall intermediate opposed upper and lower ends of the sidewall section to divide the base into upper and lower compartments, one or more sockets for receiving incandescent lamps being mounted to the lower surface of the dividing wall; a layer of insulation being positioned in the lower compartment between the sockets and the dividing wall, a layer of insulation being positioned in the upper compartment; and a mounting stud including a heat-insulating, threaded plastic stem passing through a central opening in the horizontal wall of the base for connecting with a threaded opening associated with a junction box, said lighting fixture complying with the Underwriters Laboratories 60° C. temperature limit.

Reference throughout this application to the U/L temperature limit of 60° C. refers to the requirements set forth in the first sentence of Section 27.4B, UL 57-Standard for Electrical Lighting Fixtures, dated Jan. 13, 1978.

The above-described unique arrangement of heat conductive and heat insulating materials meets the stringent 60° C. temperature limit in a low-profile pan-type fixture. In fact, in a preferred embodiment of this invention, this temperature requirement is met in a pan-type fixture having the central axes of its sockets disposed no more than about 3½" from the upper end of the base sidewall section (i.e., the end of the base generally lying flush with the ceiling.) In the most preferred embodiment of this invention the plastic stem of the mounting stud is formed of a flame-retardant thermoplastic polyester material, and the insulating layers are flat sheets of fiberglass; at least one of which preferably is coated with an aluminum layer to provide a vapor barrier.

The pan-type fixture described above typically includes a transparent or translucent cover which is removably connected to the base in overlying relationship with the incandescent light bulbs.

Other objects and advantages of this invention will become apparent by referring to the detailed description which follows, taken in conjunction with the accompanying drawing.

BRIEF DESCRIPTION OF THE DRAWING

The drawing is a partial sectional view of the pan-type lighting fixture of the instant invention.

BEST MODE FOR CARRYING OUT THE INVENTION

Referring to the drawing, the pan-type lighting fixture 10 of this invention generally includes a heat-dissipating fixture base 12; a mounting stud 13; two panels, or layers of insulation 14 and 15 and a transparent or translucent cover 16.

The heat-dissipating base 12 is formed of aluminum, or a similiar highly heat-conductive material that is capable of functioning as an excellent heatsink. Most preferably the material employed to form the base should have a thermal conductivity, k, greater than 0.4 calories per cm. per sec. per °C. Applicant has found that pan-type fixtures employing conventional steel bases having a conductivity, k, of less than 0.2 will not meet the requirements of the instant invention.

The base 12 has a generally vertical peripheral wall section 18 which preferably is circular in plan view, and which includes opposed upper and lower ends 20 and 22, respectively. A generally horizontal planar wall 24 divides the peripheral wall section 18 into an upper compartment 26 and a lower compartment 28. L-shaped mounting brackets (only one being shown at 30) are riveted to the horizontal wall 24, and are employed to mount incandescent light bulb sockets 31 to the fixture. Although only one mounting bracket and socket are shown in the FIGURE, it is understood that pan-type fixtures generally do have more than one light bulb-receiving socket. In one preferred form of this invention, two L-shaped mounted brackets are connected to the intermediate wall 24 in diametrically opposed relationship to each other to permit a pair of incandescent light bulb sockets to be mounted to the fixture. As indicated earlier in this application, the sockets employed in the pan-type fixtures of this invention are required to be generally horizontally disposed i.e., their axes do not deviate more than about 45° from the horizontal plane when the fixture is mounted on the ceiling.

In the most common pan-type fixtures of this invention the height of the base 12, between the opposed upper and lower ends 20 and 22, is less than 3", and more preferably about 2". Moveover, the central axis of each socket, prior to insertion of the light bulbs, preferably is no more than about 3½" from the upper end 20 of the base. in other words, it is not uncommon for the axis of each socket to extend below the lower end 22 of the base 12; however, the pan-type fixtures of this invention do have an extremely low profile (i.e., they are close to the ceiling), and are aesthetically quite pleasing.

An extremely important aspect of this invention relates to the construction of the mounting stud 13 employed to connect the fixture 10 to crossbar 32 of an outlet box 34. The outlet box 34 is mounted inside of ceiling 36.

The stud 13 includes a threaded plastic stem 38 that passes through an opening 39 in the horizontal wall 24 of the base 12. The stud is secured in threaded engagement with an opening 40 in the crossbar 32, and the crossbar 32 is in turn connected to the outlet box 34. A threaded cap member 42 is attached to the plastic stem at the end opposite that received within the opening 40 of the crossbar 32, and this head engages the lower surface of the intermediate wall 24 to firmly secure the base of the fixture 10 flush with the ceiling 36.

In the most preferred embodiment of this invention, the plastic stem 38 is a flame retardant, thermoplastic polyester material; one such suitable material being manufactured by General Electric Company under the trademark Valox. The most preferred material used in this invention is Valox 420-SEO, which is a glass-reinforced, self extinguishing thermoplastic polyester material.

It is most important in this invention to include insulating layers, or blocks 14 and 15 in the upper and lower compartments 26 and 28 respectively. Preferably the insulating blocks 14 and 15 are flat boards of fiberglass; about 1" thick. Most preferably at least one of the insulating layers (e.g., 14) is provided with a coating, or layer of aluminum 43 to provide a vapor barrier. A suitable aluminum coated fiberglass insulating block is sold under the name "Ultra Duct board" by Certain-Teed Corp. of Valley Forge, Pa. Applicant has successfully employed Ultra Duct board No. El 475 as a suitable insulation material to achieve the stringent Underwriters Laboratories requirements discussed in detail earlier in this application.

The structure of the preferred fixture 10 of this invention is completed by the transparent or translucent cover 16 which is removably connected to the base 12 in a conventional manner by suitable mounting screws 44.

Having described my invention, I claim:

1. A pan-type lighting fixture for mounting in association with an outlet box positioned in a ceiling, said fixture being characterized by a heat-dissipating base having a thermal conductivity, k, in excess of 0.4 calories per cm. per sec. per °C., said base having a generally vertical sidewall section and a generally horizontal, planar intermediate wall disposed between opposed ends of the sidewall section, said horizontal wall dividing the base into upper and lower compartments; at least one socket being secured to the fixture through mounting means connected to the horizontal wall and positioned in the lower compartment; a layer of insulating material disposed in the lower compartment between the sockets and the horizontal wall and a layer of insulating material disposed in the upper compartment; a mounting stud including a threaded heat-insulating plastic stem passing through a central opening in the horizontal wall of the base for connection with a threaded opening associated with the outlet box, said fixture complying with the UL temperature limit of 60° C.

2. The pan-type lighting fixture of claim 1, characterized in that the base is aluminum.

3. The pan-type lighting fixture of either claim 1 or 2, characterized in that each socket has a central axis that is no more than about 3½" from the upper end of the sidewall section of the base.

4. The pan-type lighting fixture of either claim 1 or 2 characterized in that the plastic stem of the mounting stud is comprised of a flame-retardant, thermoplastic polyester material.

5. The pan-type lighting fixture of claim 4, characterized in that each socket has a central axis that is no more than about 3½" from the upper end of the sidewall section of the base.

6. The pan-type lighting fixture of either claim 1 or 2 characterized in that the insulating layers in the upper and lower compartments are comprised of fiberglass; at least one of which includes a layer of aluminum.

7. The pan-type lighting fixture of claim 6, characterized in that each socket has a central axis that is no more than 3½" from the upper end of the sidewall section of the base.

8. The pan-type lighting fixture of claim 7 characterized in that the plastic stem is comprised of a flame-retardant thermoplastic polyester material.

* * * * *